US011408238B2

(12) United States Patent
Miranda Junior et al.

(10) Patent No.: US 11,408,238 B2
(45) Date of Patent: Aug. 9, 2022

(54) AUXILIARY DEVICE FOR LOWERING A TOOL INTO A WELL

(71) Applicant: PETRÓLEO BRASILEIRO S.A.—PETROBRAS, Rio de Janeiro (BR)

(72) Inventors: Jose Soares de Miranda Junior, Fernandópolis (BR); Orman Salvador Toscano, Vila Velha (BR); Paulo Cesar Cardoso Ferreira, Rio de Janeiro (BR); Humberto de Oliveira Reis, Belo Horizonte (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 16/639,304

(22) PCT Filed: Aug. 14, 2018

(86) PCT No.: PCT/GB2018/052307

§ 371 (c)(1),
(2) Date: Feb. 14, 2020

(87) PCT Pub. No.: WO2019/034865

PCT Pub. Date: Feb. 21, 2019

(65) Prior Publication Data

US 2021/0025254 A1 Jan. 28, 2021

(30) Foreign Application Priority Data

Aug. 14, 2017 (BR) ..... 102017017383-6

(51) Int. Cl.

| | |
|---|---|
| ***E21B 23/14*** | (2006.01) |
| ***E21B 33/072*** | (2006.01) |
| ***E21B 33/076*** | (2006.01) |

(52) U.S. Cl.
CPC ..... *E21B 23/14* (2013.01); *E21B 33/072* (2013.01); *E21B 33/076* (2013.01)

(58) Field of Classification Search
CPC ..... E21B 23/14; E21B 33/072; E21B 33/076; E21B 47/017
See application file for complete search history.

(56) References Cited

U.S. PATENT DOCUMENTS 2,440,015 A * 4/1948 Meddick ..... E21B 33/072 277/330
3,556,209 A 1/1971 Reistle et al.
(Continued)

FOREIGN PATENT DOCUMENTS

| | | |
|---|---|---|
| CN | 2837509 Y | 11/2006 |
| CN | 202953764 U | 5/2013 |
| WO | 2000060212 A1 | 10/2000 |

OTHER PUBLICATIONS

International Search Report & Written Opinion for PCT/GB2018/052307 dated Oct. 29, 2018.

*Primary Examiner* — Jonathan Malikasim
(74) *Attorney, Agent, or Firm* — ArentFox Schiff LLP

(57) ABSTRACT

The present invention relates to an auxiliary device for lowering at least one tool into a well, the auxiliary device comprising a main body configured to at least partially envelope an upper portion of the tool, wherein the main body comprises: a bottom opening configured to allow passage of the tool; and a top opening configured to block passage of the tool and allow passage of the cable supporting the tool.

19 Claims, 6 Drawing Sheets

(56) References Cited

U.S. PATENT DOCUMENTS

| | | | | | |
|---|---|---|---|---|---|
| 3,638,722 | A | | 2/1972 | Talley, Jr. | |
| 3,788,396 | A | | 1/1974 | Shatto et al. | |
| 3,835,939 | A | | 9/1974 | McEntire | |
| 3,924,686 | A | | 12/1975 | Arnold | |
| 4,277,875 | A | * | 7/1981 | Worrell | E21B 33/038 285/39 |
| 4,488,597 | A | | 12/1984 | Hoppe et al. | |
| 4,577,687 | A | | 3/1986 | Lanmon, II | |
| 5,566,761 | A | * | 10/1996 | Pallini, Jr. | E21B 33/038 166/345 |
| 2008/0264643 | A1 | | 10/2008 | Skeels et al. | |

* cited by examiner

AUXILIARY DEVICE FOR LOWERING A TOOL INTO A WELL

CROSS-REFERENCE TO RELATED APPLICATION

This application is a United States National Stage Application of co-pending International Patent Application Number PCT/GB2018/052307 filed 14 Aug. 2018, which claims priority to BR 10 2017 017383-6, filed 14 Aug. 2017, the contents of which are incorporated herein by reference in their entireties.

FIELD OF THE INVENTION

The present invention relates to an auxiliary device for lowering one or more tools inside oil wells.

BACKGROUND OF THE INVENTION

Logging or profiling operations are routine for oil wells, with the logging equipment being lowered inside the well on a steel cable that accesses the latter via an opening in the wellhead. This procedure is well known from the prior art.

Firstly, to facilitate understanding of what will be presented hereunder, it should be pointed out that in the present document, the wellhead will also be called wellhead system, or SWS (for subsea wellhead system). The use of such terms will certainly not cause confusion for comprehension of the invention, since all these terms are widely used and are known by anyone with reasonable knowledge of the subject.

The logging equipment (also known as a sonde) can be lowered and raised by means of a winch positioned in the upper part of a drilling platform.

However, owing to the weight of the logging tools and the clearance between the sonde and the well, normally friction is generated between the steel cable and the opening in the wellhead. This may cause wear at the points of contact between the cable and the wellhead, during the procedures of lowering and raising a logging device.

Although some devices are known for protecting the wellhead, in the majority of operations they are not used, since they are inconvenient and take time for installation before and after the logging process. The time taken causes an increase in the costs of the logging process.

Document U.S. Pat. No. 3,835,939 (A) discloses a device for physically restricting the lateral movement of a drill string during rotation. As described in that document, the device comprises an element with a taper hole through which the drill string passes. This device is positioned in the wellhead, preventing damage to the latter due to vibration of the string.

Thus, the device disclosed in document U.S. Pat. No. 3,835,939 (A) must be installed beforehand in the wellhead before starting any process of lowering tools in the well, such as the logging process, for example.

Document CN2837509 (Y) discloses a logging cable protector that comprises a pulley system that diverts the logging cable in the entrance of the wellhead to allow it to enter laterally, thus preventing contact thereof with the wellhead, and reducing damage due to the movement of the cable.

Accordingly, this device also requires a process of installing the SWS protection system, before starting the process of lowering tools in the well.

Document CN202953764 (U) discloses a logging cable guide to be installed in an SWS that comprises a pulley system for directing the logging cable towards the central region of a wellhead, so as to avoid contact thereof with the latter, preventing damage due to rubbing.

As in the preceding cases, the system disclosed requires prior installation of the logging cable guide in the SWS.

Document WO2000060212 (A1) discloses a pulley system for controlling a logging cable, so that the latter is inserted in a well through a sub with a lateral opening (known as a side entry sub).

The side entry sub then directs the cable towards the central region of the well, so that the cable is then connected to the logging element, already inside the well.

Thus, for use of the system disclosed in that document it is also necessary to install the side entry sub device before starting the process of lowering tools into the well.

It is therefore clear that an auxiliary device for lowering at least one tool into a well that does not require prior installation of equipment, and that optionally provides automatic release of the tool in question, is not known from the prior art.

SUMMARY OF THE INVENTION

The present document discloses an auxiliary device for lowering at least one tool into a well that protects the SWS from possible damage and does not require prior installation of equipment.

According to a first aspect of the invention, there is provided an auxiliary device for lowering a tool supported by a cable into a well, the auxiliary device comprising a main body configured to at least partially envelope an upper portion of the tool, wherein the main body comprises: a bottom opening configured to allow passage of the tool; and a top opening configured to block passage of the tool and allow passage of the cable supporting the tool.

Optionally, the auxiliary device further comprises an actuating mechanism, the actuating mechanism configured to switch the auxiliary device from a first configuration preventing displacement of the tool with respect to the auxiliary device, when the main body at least partially envelopes the upper portion of a tool, to a second configuration in which the tool is released and displacement relative to the auxiliary device is possible.

Optionally, the actuating mechanism is configured to switch the auxiliary device from the first configuration to the second configuration by being positioned on or in a well.

Optionally, the actuating mechanism comprises a locking pin, wherein the locking pin is configured to prevent displacement of the tool relative to the auxiliary device when the tool is in the first configuration and to release the tool and allow displacement of the tool relative to the auxiliary device in the second configuration.

Optionally, the actuating mechanism comprises an elastic element, wherein, in the first configuration, the elastic element biases the locking pin so that the locking pin prevents displacement of the tool relative to the auxiliary lowering device.

Optionally, the actuating mechanism comprises an actuating element for the locking pin, the actuating element being configured, when switching from the first configuration to the second configuration, to actuate the locking pin to release the tool and allow displacement of the tool relative to the auxiliary device.

Optionally, the actuating element is actuated by contact with the well.

Optionally, the auxiliary device according to the first aspect further comprises a jacket within the main body, configured to at least partially envelope the tool.

Optionally, the auxiliary device further comprises an actuating mechanism, the actuating mechanism configured to switch the auxiliary device from a first configuration preventing displacement of the jacket within the main body of the of the auxiliary device to a second configuration in which the jacket is released and displacement relative to the auxiliary device is possible.

Optionally, the actuating mechanism is configured to switch the auxiliary device from the first configuration to the second configuration by being positioned on or in a well.

Optionally, the actuating mechanism comprises a first activating pin at least partially housed within the main body, and a second activating pin at least partially housed inside the jacket, and wherein the first activating pin is configured to actuate the second activating pin when switching from the first configuration to the second configuration.

Optionally, the auxiliary device further comprises a spring configured to urge displacement of the jacket relative to the main body.

Optionally, the auxiliary device further comprises a locking pin comprising a first end configured to engage with and lock into the jacket in the first configuration and a second end configured to project out of the main body to engage with and lock into the well in the second configuration.

Optionally, the profile of the first end of the locking pin is a cam.

Optionally, the main body comprises a stop around the lower opening configured to prevent passage of the jacket.

Optionally, the main body further comprises a protective element for the cable, the protective element positioned in the top opening.

Optionally, the main body is provided with a side opening configured to allow passage of the supporting cable, to fit the auxiliary device around the cable and over the tool.

Optionally, the main body comprises a relief through-hole suitable for allowing flow past the auxiliary device when it is positioned in or on the well.

According to a second aspect of the invention, there is provided an auxiliary device for lowering at least one tool into a well, characterized in that it comprises a main body at least partially enveloping the upper portion of the tool, wherein the main body comprises: a bottom opening for allowing passage of the tool; and a top opening suitable for blocking passage of the tool and allowing passage of a cable for supporting the tool, wherein the device additionally comprises at least one locking pin, wherein the at least one locking pin is suitable for: preventing displacement of the tool relative to the auxiliary lowering device when the tool is suspended on a suspension cable; and releasing displacement of the tool relative to the auxiliary lowering device when the auxiliary device for lowering at least one tool in a well is positioned in an SWS.

According to a third aspect of the invention, there is provided a method of protecting a well and cable when lowering a tool supported by the cable into the well, the method comprising: attaching the tool to the cable; positioning an auxiliary device on the tool, after it is supported on the cable, to at least partially envelope the upper portion of the tool, lowering the tool and auxiliary device into the well, to bring the auxiliary device into contact with the well; releasing the tool from the auxiliary device and further lowering the tool into well.

Optionally, in the method of the third aspect, the auxiliary device is the auxiliary device of any of the variations of the first and second aspects.

According to a fourth aspect of the invention, there is provided a system comprising a well; a tool; a cable supporting the tool, for lowering the tool into the well; and an auxiliary device; the auxiliary device comprising: a main body at least partially enveloping the upper portion of the tool, wherein the main body comprises: a bottom opening configured to allow passage of the tool; and a top opening configured to block passage of the tool and allow passage of the cable supporting the tool.

Optionally, the system further comprises an actuating mechanism, the actuating mechanism configured to switch the auxiliary device from a first configuration preventing displacement of the tool within the main body of the of the auxiliary device to a second configuration in which the tool is released and displacement relative to the auxiliary device is permitted.

Optionally, the system further comprises a jacket within the main body, configured to at least partially envelope the tool. The system can further comprise an actuating mechanism, the actuating mechanism configured to switch the auxiliary device from a first configuration preventing displacement of the jacket within the main body of the of the auxiliary device to a second configuration in which the jacket is released and displacement relative to the auxiliary device is permitted.

Optionally, any actuating mechanism is configured to switch the auxiliary device from the first configuration to the second configuration by being positioned on or in a well.

There is also disclosed an auxiliary device for lowering at least one tool into a well that comprises a main body at least partially enveloping the upper portion of the tool, wherein the main body comprises: a bottom opening for allowing passage of the tool; and a top opening suitable for blocking passage of the tool and allowing passage of a cable supporting the tool. In addition, the device comprises at least one locking pin, wherein the at least one locking pin is suitable for: preventing displacement of the tool relative to the auxiliary lowering device when the tool is suspended on a suspension cable; and releasing the displacement of the tool relative to the auxiliary lowering device when the auxiliary device for lowering at least one tool into a well is positioned in an SWS.

There is also disclosed an auxiliary device for lowering at least one tool into a well, characterized in that it comprises a main body (1) at least partially enveloping the upper portion of the tool (2), wherein the main body (1) comprises: a bottom opening for allowing passage of the tool (2); and a top opening suitable for blocking passage of the tool (2) and allowing passage of a cable (5) for supporting the tool (2), wherein the device additionally comprises at least one locking pin (3), wherein the at least one locking pin (3) is suitable for: preventing displacement of the tool (2) relative to the auxiliary lowering device when the tool (2) is suspended on a suspension cable (5); and releasing displacement of the tool (2) relative to the auxiliary lowering device when the auxiliary device for lowering at least one tool (2) in a well is positioned in an SWS (7).

Optionally, the at least one locking pin (3) comprises an elastic element (31), wherein, when the system is suspended on a supporting cable (5), the elastic element (31) is suitable for activating the locking pin (3) to prevent displacement of the tool (2) relative to the auxiliary lowering device. The main body (1) may comprise a protective element (4) of the cable (5) positioned in the top opening.

Optionally, it comprises at least one actuating element (6) of the locking pin (3) suitable for actuating the locking pin (3) to release displacement of the tool (2) relative to the auxiliary lowering device when the auxiliary device for lowering at least one tool (2) in a well is positioned in an SWS (7), wherein the at least one actuating element (6) of the locking pin is activated by contact with the SWS (7).

Optionally, the at least one actuating element (6) of the locking pin (3) comprises an elastic element (31), wherein the elastic element is suitable for maintaining the at least one actuating element (6) of the locking pin (3) in an extended position when the tool (2) is suspended on a supporting cable (5).

Optionally, the elastic element (31) is at least partially compressed when the auxiliary device for lowering at least one tool (2) in a well is positioned in the SWS (7).

Optionally, it additionally comprises a jacket (12) suitable for at least partially enveloping the at least one tool (2).

Optionally, the main body (1) is provided with a side opening (9) suitable for allowing passage of a supporting cable (5).

Optionally, the main body (1) comprises at least one relief through-hole (10) suitable for allowing passage of flow.

Optionally, it comprises a jacket (12) at least partially enveloping the tool (2).

Optionally, it comprises activating pins suitable for actuating activating pins inside the jacket (12), wherein the internal activating pins are suitable for releasing the jacket (12).

Optionally, it comprises a spring (8) positioned in the upper portion of the jacket (12), wherein the spring is suitable for impelling the jacket (12) to perform a downward movement.

Optionally, the profile of the engagement between the at least one locking pin (3) and the jacket (12) is a cam.

Optionally, the main body comprises in its lower portion a stop (11) suitable for preventing passage of the jacket (12).

Optionally, it comprises four locking pins.

BRIEF DESCRIPTION OF THE FIGURES

The detailed description presented hereunder refers to the appended figures and their respective reference numbers.

DETAILED DESCRIPTION OF THE INVENTION

Firstly, it is emphasized that the following description will be based on preferred embodiments of the invention, applied to auxiliary devices for lowering a tool for logging operations in a well. As will be obvious to a person skilled in the art, however, the invention is not limited to these particular embodiments, since the invention described may be applied for aiding the lowering of any tools in a well, where it is desired to protect the SWS.

Figure 1:
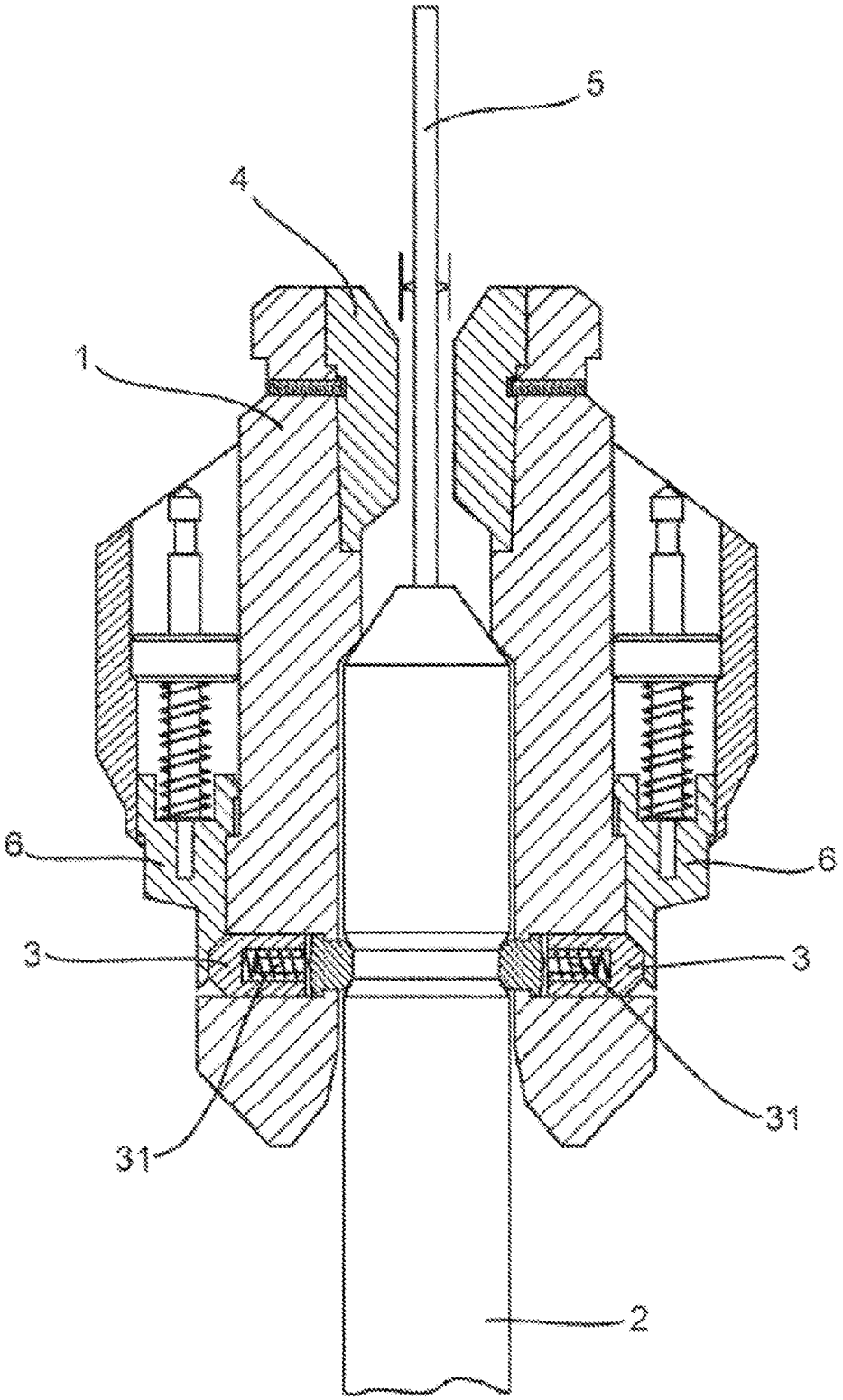
FIG. 1 shows a sectional view of a first optional configuration of an auxiliary device for lowering a tool into a well.

FIG. 1 shows a sectional view of an optional configuration, illustrating a tool 2 to be lowered into an oil well and an auxiliary device for lowering at least one tool into a well, wherein the device and the tool 2 are suspended on a cable 5. A discussed above, the tool 2 may be a logging or profiling tool, such as a sonde.

The auxiliary device comprises a main body 1. The main body is configured to at least partially envelope the upper portion of the tool 2, as shown in FIG. 1. The main body 1 comprises a bottom opening for allowing passage of the tool 2, and a top opening suitable for blocking passage of the tool 2. However, the top opening is configured to allow passage of a cable 5 for supporting the tool 2. The bottom and top openings are connected within the main body by a cavity in which at least an upper end of the tool 2 can be received. In the configuration presented, blocking of the passage of the tool 2 in the upper portion of this cavity, and thus through the top opening, is provided by narrowing of the cavity within the main body 1. As such, the top opening comprises a smaller diameter than the bottom opening. The diameter of the top opening is thus wider than the cable 5, but narrower than the tool 2.

In addition, the auxiliary device (also known as an auxiliary lowering device) can comprise at least one locking pin 3. As shown in FIG. 1, the at least one locking pin 3 is suitable for preventing displacement of the tool 2 relative to the auxiliary lowering device when the tool 2 is suspended on a suspension cable 5 (i.e. before the tool is lowered into the well). That is, the locking pin 3 can extend into an area of reduced width in the top portion of the tool 2, and thus prevent the tool being displaced with respect to the auxiliary device.

Optionally, the main body 1 further comprises a protective element 4 for cable 5. The protective element 4 can be positioned in the top opening. The protective element 4 can be made of a non-abrasive material, so as to prevent damage to the cable 5 while lowering the tool 2 in the well. For example, the protective element may be made of a plastic, for example. In alternative configurations, the protective element 4 for cable 5 may comprise a system with rotating elements, or any other configuration that minimizes the friction between the cable 5 and the auxiliary lowering device.

In use, the auxiliary device is suspended together with the tool 2, when the tool 2 is suspended on the suspension cable 5 for positioning before entering the well. In practice, the auxiliary device is positioned to at least partially envelope the upper portion of the tool 2 after the tool has been attached to the cable. Thus, the auxiliary device is supported on the upper part of the tool 2, as can be seen in FIG. 1. In this way, the auxiliary device can be brought to the well together with the tool 2 to be installed, without the need for prior installation of a device for this purpose. The tool 2 and auxiliary device can then be lowered into the well.

Optionally, the at least one locking pin 3 comprises an elastic element 31. When the system of the tool 2 and the auxiliary device is suspended on a supporting cable 5, the elastic element 31 is configured to activate the locking pin 3, by urging the locking pin towards the tool 2 and to prevent displacement of the tool 2 relative to the auxiliary lowering device. As discussed above, in the example of FIG. 1, the elastic element 31 presses the locking pin 3 against a setback in the body of the tool 2, so that the tool 2 does not move relative to the main body 1.

Also optionally, each locking pin 3 is divided into two portions connected by the elastic element 31. The two portions can correspond to two ends of the pin 3. One end of the pin 3 projects inwardly into the cavity within the main body 1 and can lock into the tool as discussed above. The other end can project in the other direction, towards an actuating member, as discussed below. In any case, when a pin 3 is in its compressed position, with the two ends compressing the elastic element 31 between them, it exerts pressure against the tool 2, making displacement of the tool 2 impossible.

In this optional configuration, compression of the at least one locking pin 3 is effected by at least one actuating element 6, which is arranged for compressing the at least one locking pin 3 when the tool 2 is suspended on a supporting cable 5. The at least one actuating element 6, at least one locking pin 3 and at least one elastic element 31 constitute an actuating mechanism for switching the auxiliary device from a first configuration preventing displacement of the tool 2 with respect to the auxiliary device, to a second configuration in which the tool is released and displacement relative to the auxiliary device is possible. In this embodiment, the at least one actuating element 6 comprises a portion fixed to the main body of the auxiliary device for lowering tools in a well, and a movable portion connected to the fixed portion by an elastic element. Thus, when the assembly is suspended on the suspension cable 5, the elastic element urges the movable portion against the at least one locking pin 3, holding it in its position of locking the tool 2.

Figure 2:
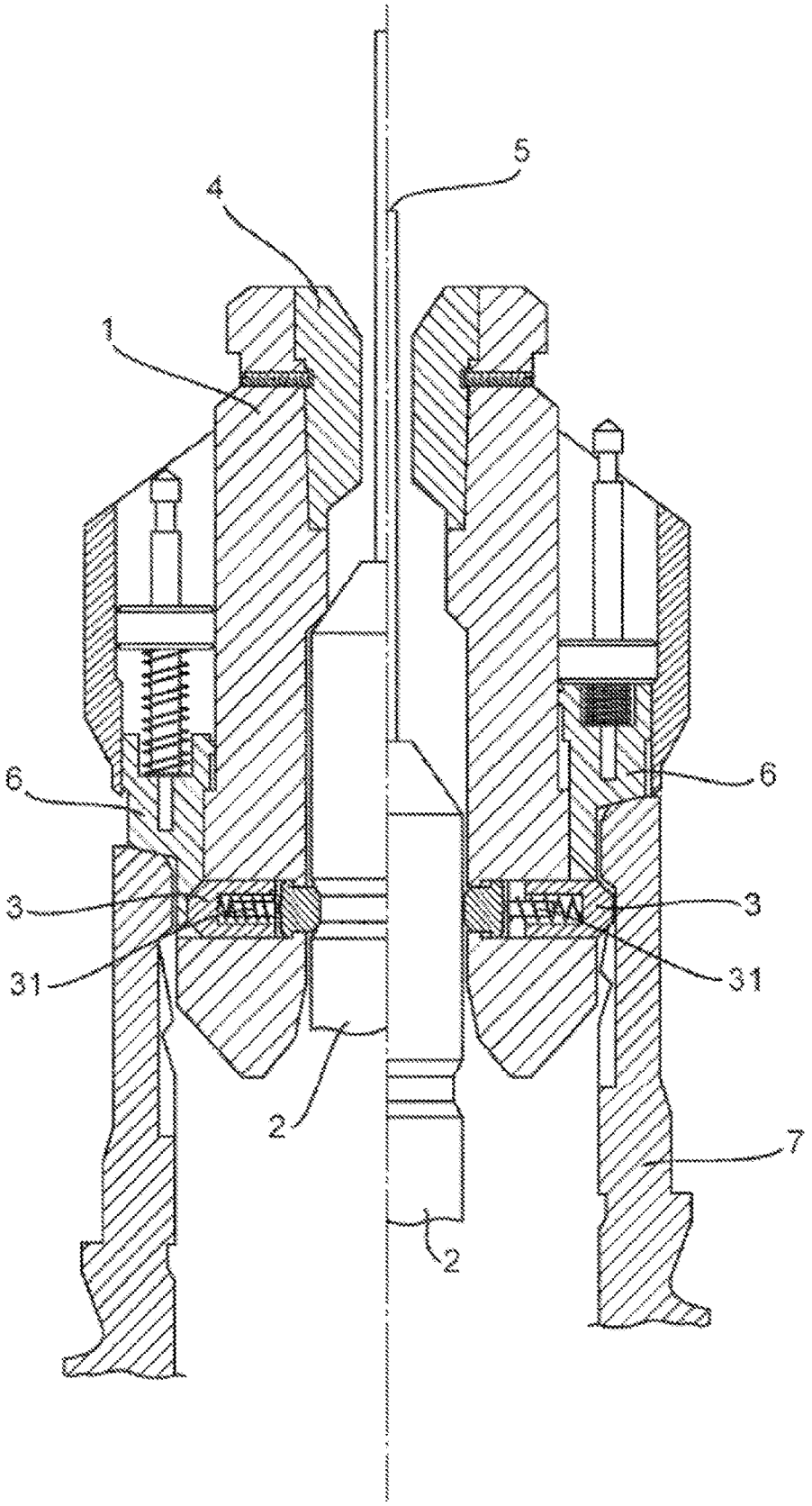
FIG. 2 shows a sectional view of the optional configuration illustrated in FIG. 1, wherein the auxiliary device for lowering at least one tool into a well is located in an SWS.

FIG. 2 shows a sectional view of an optional configuration in which the auxiliary device is located in an SWS 7. For clearly illustrating the operation of the device, FIG. 2 is split in the middle, with the left side representing the device before being fully positioned in the SWS 7, and the right side representing the device after being fully positioned in the SWS 7. It can be seen that at least a portion of the main body 1 extends into the SWS 7 during fitting of the auxiliary device for lowering the tool 2 in the SWS 7.

This figure shows more clearly that the locking pin 3 is suitable for releasing the displacement of the tool 2 relative to the auxiliary lowering device when the auxiliary device for lowering at least one tool 2 in a well is positioned in an SWS 7.

For release of the tool 2 to occur (in other words to transition from the first configuration on the left hand side of FIG. 2 to the second configuration on the right hand side of FIG. 2), the device comprises the aforementioned actuating mechanism, which is activated by the auxiliary device being positioned on the well. That is, the at least one actuating element 6 actuates the locking pin 3 to release displacement of the tool 2 relative to the auxiliary lowering device. This occurs when the auxiliary device is positioned in an SWS 7, wherein the at least one actuating element 6 of the locking pin 3 is activated by contact with the SWS 7.

More specifically, as can be seen in the optional configuration illustrated, when the auxiliary lowering device is positioned in the SWS 7, the weight of the assembly means that the SWS 7 exerts a force on the movable portion of actuating element 6, overcoming the force exerted by the elastic element within the actuating element. As such, the movable portion of the actuating element 6 is displaced vertically upwards relative to the rest of the auxiliary device. This relative movement at least partially compresses the elastic element connecting the movable and fixed portions of the actuating element 6. As a result, the movable portion loses contact with the at least one locking pin 3, releasing the locking pin 3, and consequently releasing displacement of the tool 2.

In other words, in the configuration illustrated, when the device is positioned in the SWS 7 the actuating element 6 is displaced vertically, releasing the locking pin 3, which expands. Thus, the elastic element 31 of the locking pin 3 is expanded, so that the pressure exerted against the tool 2 is reduced so that the weight of the tool 2 is sufficient for it to push the locking pin 3 out of the way to allow it to move vertically downwards.

It is emphasized that the configuration of the at least one locking pin 3 and at least one actuating element 6 of the locking pin 3 described up to now is optional, so that variations of this configuration may be envisaged, while remaining within the scope of the invention.

Figure 3:
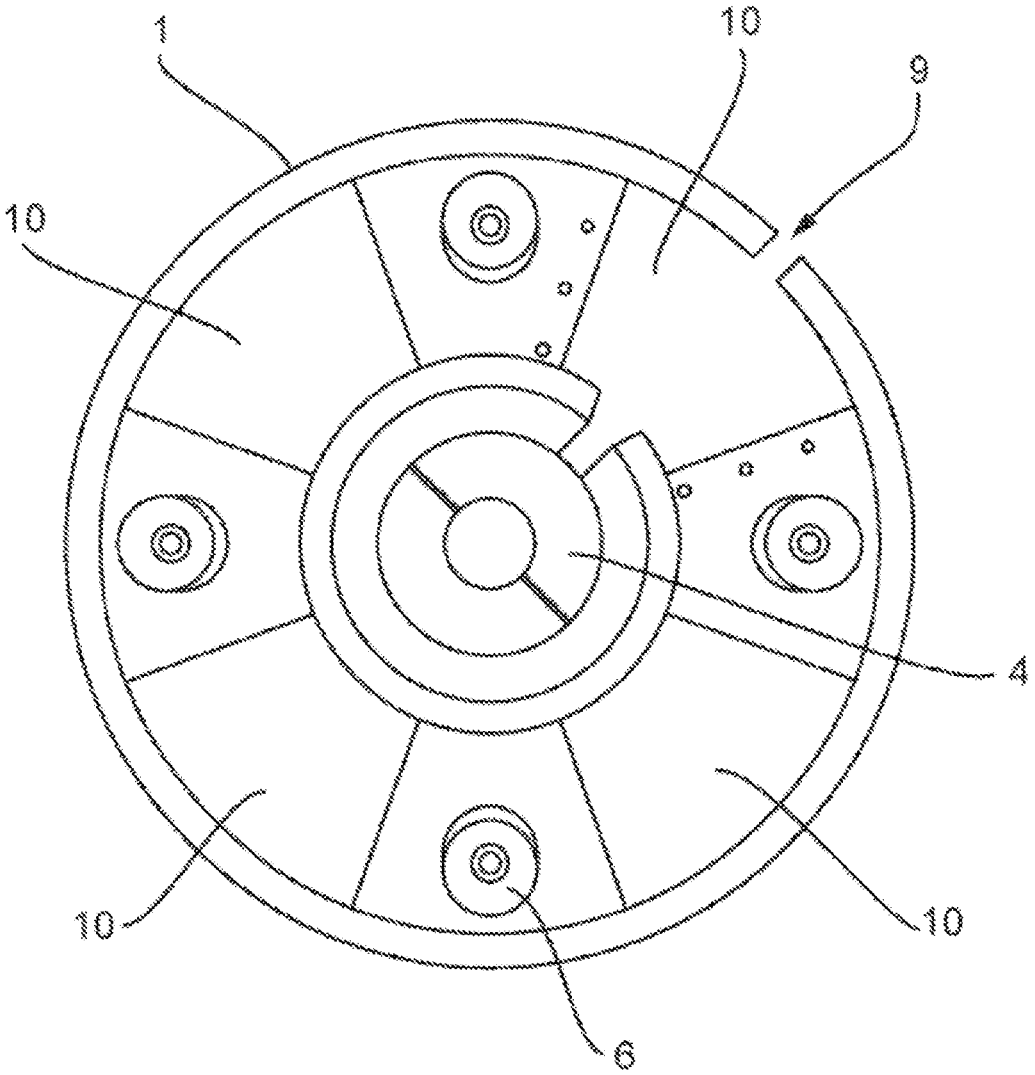
FIG. 3 shows a top view of the optional configuration illustrated in FIG. 1.

FIG. 3 shows a top view of the optional configuration of the device of FIG. 1, in which it can be seen that four actuating elements 6 are employed, associated with four locking pins 4. This configuration is adopted in this example as it ensures greater stability of the system, but there is no restriction on the quantity of actuating elements/locking pins (6,4) to be adopted in the invention in general, and it may vary from one up to as many, as desired.

It may also be noted that the main body 1 comprises at least one relief through-hole 10 suitable for allowing passage of a stream contained in a pipeline. It is possible to employ as many relief through-holes 10 as desired. In other words, the relief through-holes 10 allow flow through the device when it is positioned on or in the well.

Optionally, the main body 1 is provided with a side opening 9 suitable for passage of a supporting cable 5. With this opening 9, the auxiliary device for lowering at least one tool is easily positioned on the tool 2 very quickly and efficiently. When the tool 2 is suspended on the suspension cable 5, the device can be supported on it easily, so that the cable 5 is passed through the side opening 9.

Figure 4:
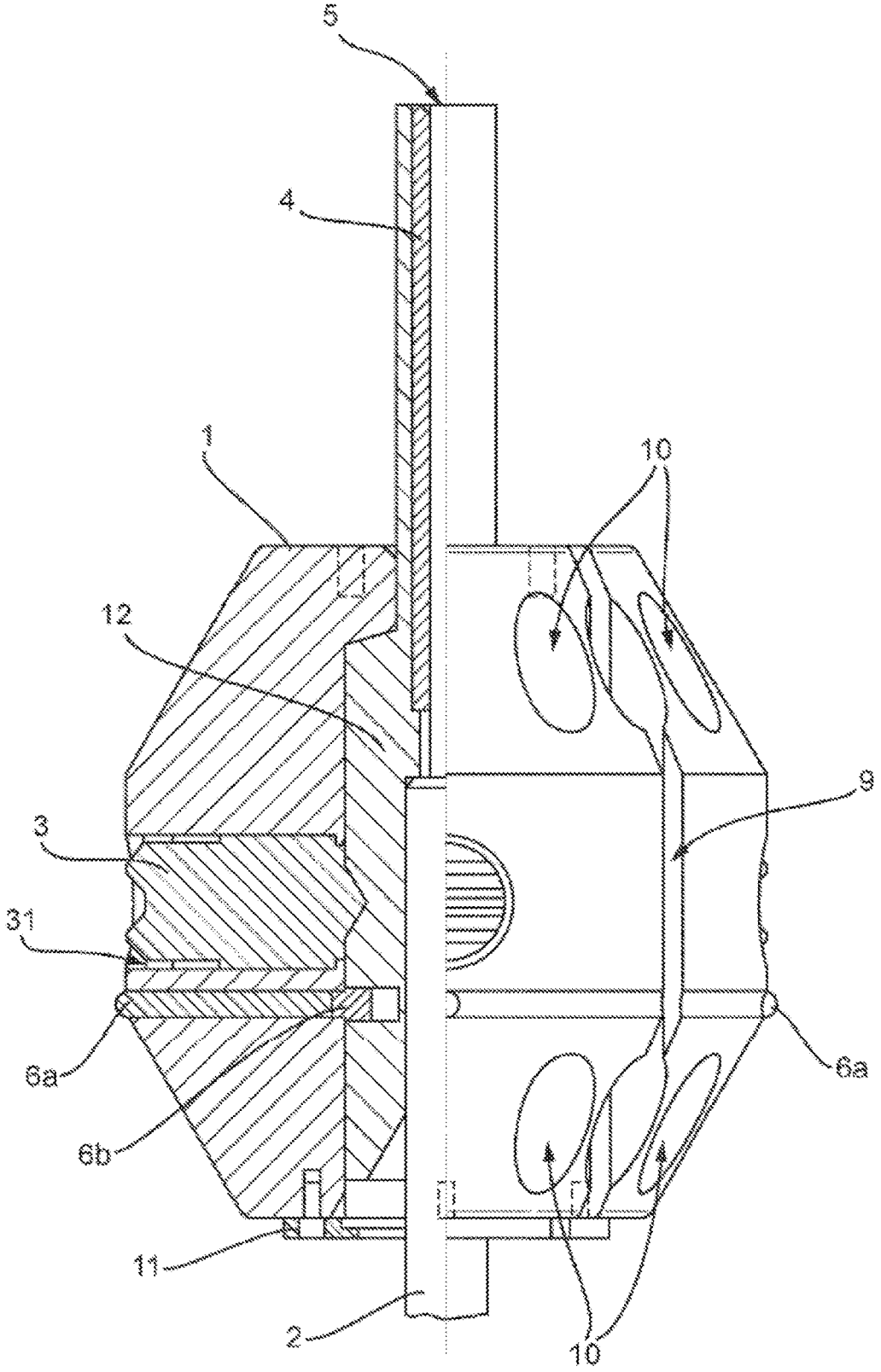
FIG. 4 shows a partial sectional view of a second optional configuration of an auxiliary device for lowering a tool into a well.

FIG. 4 shows a partial sectional view of a second optional configuration of an auxiliary device for lowering a tool into a well suspended on a suspension cable 5.

In this optional configuration, although the shape of the device differs from the first configuration, there are common elements with the first configuration. In particular, device comprises a main body 1 configured to at least partially envelope the upper portion of the tool 2. The main body 1 comprises a bottom opening for allowing passage of the tool 2, and a top opening suitable for blocking passage of the tool 2. As in the first configuration, the top opening allows passage of a cable 5 supporting the tool 2 whilst blocking the tool itself. Once again, in the configuration presented, blocking of the passage of the tool 2 in the upper portion of the main body 1 is provided by narrowing the cavity connecting the bottom and top holes of the main body 1, such that the top opening comprises a smaller diameter than the bottom opening.

In addition, the auxiliary lowering device comprises at least one locking pin 3, wherein the at least one locking pin 3 is suitable for preventing displacement of the tool 2 relative to the auxiliary lowering device when the tool 2 is suspended on a suspension cable 5.

As in the first embodiment, the auxiliary device of FIG. 4 can be suspended together with the tool 2, when the tool 2 is suspended on the suspension cable 5 for positioning before entering the well. It thus remains supported in the upper part of the tool 2, as can be seen in FIG. 4 (in the same way as described in the optional configuration presented in FIGS. 1 to 3). Thus, the auxiliary device can be brought to the well together with the tool 2 to be installed, without the need for prior installation of a device for this purpose.

In this optional configuration, the auxiliary device for lowering at least one tool also comprises a jacket 12 at least partially enveloping the tool 2. The jacket 12 is within the main body 1, within the cavity connecting the bottom and top holes. The function of this jacket 12 is to protect the tool 2 against contact with the device, among other functions that will be described in this document.

The at least one locking pin 3 of the FIG. 4 embodiment comprises a first end configured to engage with and lock into the jacket 12, as shown in FIG. 4. This prevents the jacket 12 moving with respect to the main body 1. The pin 3 has a second end which can project out of the main body to engage with and lock into the well, as discussed further below.

Optionally, the at least one locking pin 3 comprises an elastic element 31, wherein, when the system is suspended on a supporting cable 5 (i.e. before insertion into a well), the elastic element 31 is suitable for activating the locking pin 3 to prevent displacement of the jacket 12, and consequently prevent movement of the tool 2, relative to the auxiliary lowering device. In this example, the elastic element 31 presses the locking pin 3 against a setback in the body of the jacket 12, so that the tool 2 does not move relative to the jacket 12 and to the main body 1.

Optionally, the jacket 12 further comprises a protective element 4 for the cable 5. The protective element 4 can be positioned in the upper portion of the jacket 12 and can extend through the top opening of the main body 1. The protective element 4 can be made of a non-abrasive material, so as to prevent damage to the cable 5 while lowering the tool 2 in the well; this material may be a plastic, for example. In alternative configurations, the protective element 4 of the cable 5 may comprise a system with rotating elements, or any other configuration that minimizes the friction between the cable 5 and the auxiliary lowering device.

Figure 5:
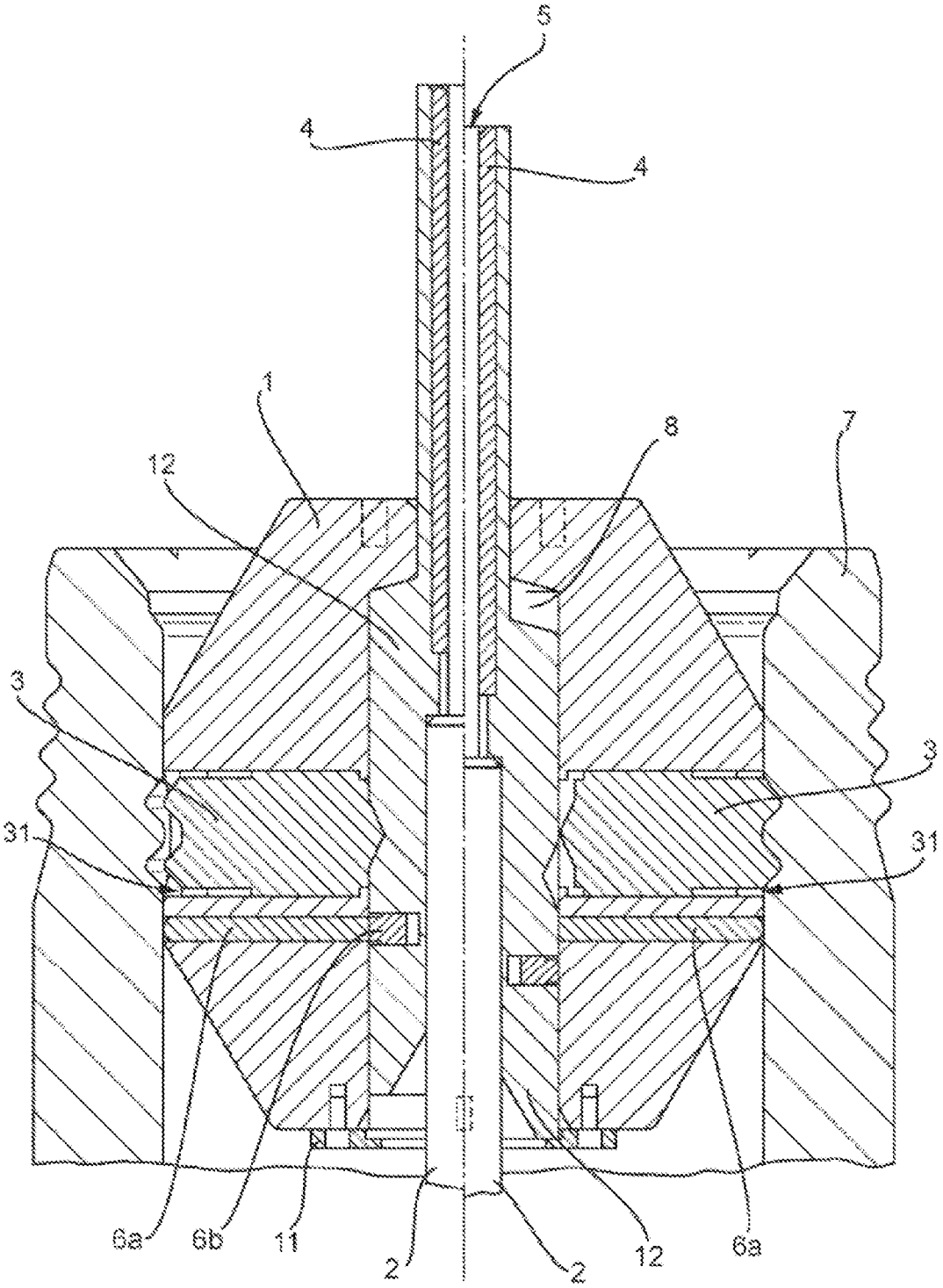
FIG. 5 shows the auxiliary device of FIG. 4 in its final position, positioned in an SWS.

FIG. 5 shows the auxiliary device for lowering at least one tool into a well of FIG. 4 in its final position positioned in an SWS 7.

For clearly illustrating the operation of the device, FIG. 5 is split in the middle, wherein the left side representing the device when it is duly positioned in the SWS 7, but not yet fully fitted, and the right side representing the device when it is fully fitted in the SWS 7. It can be seen that in this configuration, fastening of the device is provided by engagement of the locking pin 3 in a recess inside the SWS 7. In other words, the left hand side of FIG. 5 shows a transition point between the first configuration of FIG. 4 and the second configuration of the right hand side of FIG. 5.

To actuate the second ends of the locking pins 3 to be moved radially outwards, providing blocking of the device by engaging and locking into the surrounding well, the device also comprises first and second activating pins 6*a*, 6*b*. First activating pins 6*a* are at least partially housed inside the main body 1. In the first configuration of FIG. 4, an outer end of the first activating pins 6*a* project from an outer periphery of the main body 1. When the main body 1 is within the well, the outer ends of the first activating pins 6*a* are pushed into the main body 1, with the result that the opposite ends of the activating pins 6*a* actuating second activating pins 6*b*. Second activating pins 6*b* are at least partially housed inside the jacket 12. However, in the first configuration of FIG. 4, an outer ends of the second activating pins 6*b* project out of the jacket 12, into the channels in the main body 1 housing the first activating pins 6*a*. Hence, when the first activating pins 6*a* actuate the second activating pins 6*b* and push the second activating pins into the jacket 12, the jacket 12 is released. That is, the first activating pins 6*a* are actuated by the inside wall of the SWS 7, which presses them against the second activating pins 6*b* inside the jacket 12, which releases the downward movement of the jacket 12. To impel the movement of the jacket 12, the auxiliary device further comprises upper springs 8 that impel the jacket 12 to perform a downward movement with respect to the main body 1.

Once the activating pins 6*a*, 6*b* have released the jacket 12 for movement, the jacket 12 can provide movement of the locking pins 3. The profile of the inner ends of the locking pins 3, which project into the jacket 12 to engage and lock with it, is a cam shape. Thus, the weight of the jacket 12 (assisted by the spring 8) pushes the pins 3 to the side, so that the other (outer) ends of the pins 3 project into and lock in the SWS 7 (or high-pressure housing). It is thus apparent that the locking pins 3, the first and second activating pins 6*a*, 6*b*, the elastic member 31 and spring 8 contribute to an overall actuating mechanism in the embodiment of FIGS. 4 & 5.

Optionally, the main body 1 of the auxiliary device for lowering at least one tool into a well comprises, in its lower portion, a stop 11 that prevents passage of the jacket 12. Thus, the jacket 12 is not moved together with the tool 2 into the pipeline. That is, the auxiliary device can release the tool 2 into the pipeline without the jacket 12, although the jacket 12 is released to move within the main body 1 as part of the deployment of the tool 2.

Figure 6:
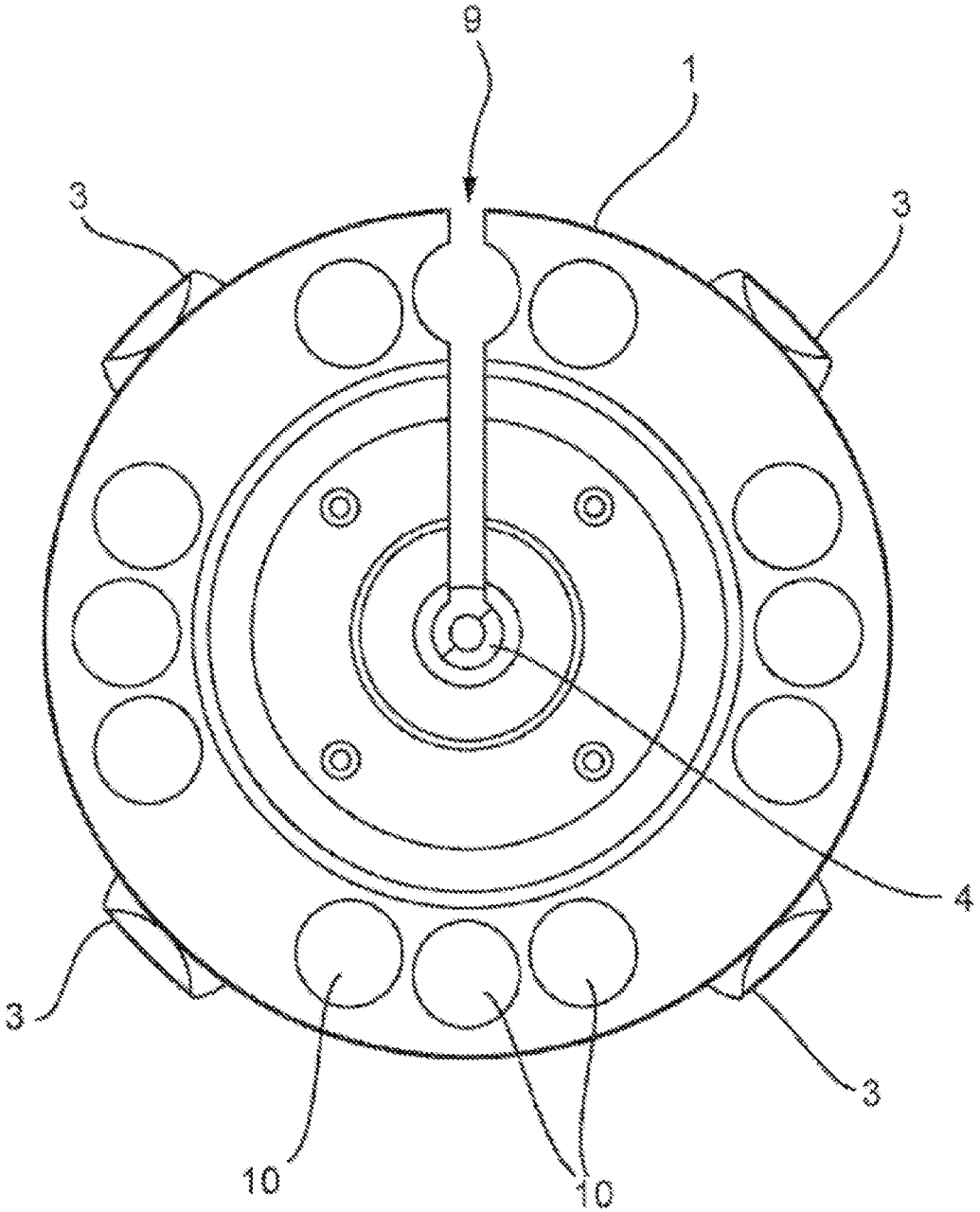
FIG. 6 shows a top view of the device illustrated in FIG. 4.

FIG. 6 shows a top view of the optional configuration of the device illustrated in FIGS. 4 and 5, in which it can be seen that optionally four locking pins are employed. This configuration is adopted as it ensures greater stability of the system, but there is no restriction on the quantity of locking pins to be adopted, and it may vary from one up to as many as desired.

It may also be noted that the main body 1 comprises at least one relief through-hole 10 suitable for allowing passage of a stream contained in a pipeline. It is possible to employ as many relief through-holes 10 as desired.

Optionally, the main body 1 is provided with a side opening 9 suitable for passage of a suspension cable 5. With this opening, the auxiliary device for lowering at least one tool 2 is easily positioned on the tool 2 very quickly and efficiently. When the tool 2 is suspended on the suspension cable 5, the device can be supported on it easily, so that the cable 5 is passed through the side opening 9.

It is therefore clear that the present disclosure provides an auxiliary device for lowering at least one tool into a well that solves the aforementioned problems of the prior art, namely the innovative device now described makes it possible to lower a tool 2 in a well while protecting the SWS 7 from possible damage and does not require prior installation of additional equipment.

Numerous variations falling within the scope of protection of the present application are permitted. This reinforces the fact that the present invention is not limited to the particular configurations/embodiments described above. As such, modifications of the above-described apparatuses and methods, combinations between different variations as practicable, and variations of aspects of the invention that are obvious to those of skill in the art are intended to be within the spirit and scope of the claims.

The invention claimed is:

1. An auxiliary device for lowering a tool supported by a cable into a well, the auxiliary device comprising a main body configured to at least partially envelope an upper portion of the tool, wherein the main body comprises:

a bottom opening configured to allow passage of the tool;

a top opening configured to block passage of the tool and allow passage of the cable supporting the tool; and an actuating mechanism comprising a locking pin, wherein the locking pin is configured to prevent displacement of the tool relative to the auxiliary device when the tool is in a first configuration and to release the tool and allow displacement of the tool relative to the auxiliary device in a second configuration.

2. The auxiliary device according to claim 1, wherein the actuating mechanism is configured to switch the auxiliary device from the first configuration preventing displacement of the tool with respect to the auxiliary device, when the main body at least partially envelopes the upper portion of the tool, to the second configuration in which the tool is released and displacement of the tool relative to the auxiliary device is possible.

3. The auxiliary device according to claim 2, wherein the actuating mechanism is configured to switch the auxiliary device from the first configuration to the second configuration by being positioned on or in the well.

4. The auxiliary device according to claim 1, wherein the actuating mechanism comprises an elastic element, wherein, in the first configuration, the elastic element biases the locking pin so that the locking pin prevents displacement of the tool relative to the auxiliary device.

5. The auxiliary device according to claim 1, wherein the actuating mechanism comprises an actuating element for the locking pin, the actuating element being configured, when switching from the first configuration to the second configuration, to actuate the locking pin to release the tool and allow displacement of the tool relative to the auxiliary device.

6. The auxiliary device according to claim 5, wherein the actuating element is actuated by contact with the well.

7. The auxiliary device according to claim 1, further comprising a jacket within the main body, configured to at least partially envelope the tool.

8. The auxiliary device according to claim 7, wherein the actuating mechanism is configured to switch the auxiliary device from the first configuration preventing displacement of the jacket within the main body of the auxiliary device to the second configuration in which the jacket is released and displacement of the jacket relative to the auxiliary device is possible.

9. The auxiliary device according to claim 8, wherein the actuating mechanism is configured to switch the auxiliary device from the first configuration to the second configuration by being positioned on or in the well.

10. The auxiliary device according to claim 8, wherein the actuating mechanism comprises a first activating pin at least partially housed within the main body, and a second activating pin at least partially housed inside the jacket, and wherein the first activating pin is configured to actuate the second activating pin when switching from the first configuration to the second configuration.

11. The auxiliary device according to claim 8, wherein the locking pin comprises a first end configured to engage with and lock into the jacket in the first configuration and a second end configured to project out of the main body to engage with and lock into the well in the second configuration.

12. The auxiliary device according to claim 11, wherein a profile of the first end of the locking pin is a cam.

13. The auxiliary device according to claim 7, further comprising a spring configured to urge displacement of the jacket relative to the main body.

14. The auxiliary device according to claim 7, wherein the main body comprises a stop around the bottom opening configured to prevent passage of the jacket.

15. The auxiliary device according to claim 1, wherein the main body further comprises a protective element for the cable, the protective element positioned in the top opening;

wherein the main body is provided with a side opening configured to allow passage of the cable to fit the auxiliary device around the cable and over the tool; and wherein the main body comprises a relief through-hole suitable for allowing flow through the auxiliary device when the auxiliary device is positioned in or on the well.

16. A method of protecting a well and a cable when lowering a tool supported by the cable into the well, the method comprising:

attaching the tool to the cable;

positioning an auxiliary device on the tool, after it is supported on the cable, to at least partially envelope an upper portion of the tool, lowering the tool and auxiliary device into the well, to bring the auxiliary device into contact with the well;

releasing the tool from the auxiliary device and further lowering the tool into the well, and preventing, via a locking pin of an actuating mechanism, displacement of the tool relative to the auxiliary device when the tool is in a first configuration and to release the tool and allow displacement of the tool relative to the auxiliary device in a second configuration.

17. A system comprising a well; a tool; a cable supporting the tool for lowering the tool into the well; and an auxiliary device, the auxiliary device comprising:

a main body at least partially enveloping an upper portion of the tool, wherein the main body comprises:

a bottom opening configured to allow passage of the tool; and a top opening configured to block passage of the tool and allow passage of the cable supporting the tool; and an actuating mechanism comprising a locking pin, wherein the locking pin is configured to prevent displacement of the tool relative to the auxiliary device when the tool is in a first configuration and to release the tool and allow displacement of the tool relative to the auxiliary device in a second configuration.

18. The system according to claim 17, wherein the actuating mechanism is configured to switch the auxiliary device from the first configuration preventing displacement of the tool within the main body of the auxiliary device to the second configuration in which the tool is released and displacement of the tool relative to the auxiliary device is permitted, wherein the actuating mechanism is configured to switch the auxiliary device from the first configuration to the second configuration by being positioned on or in the well.

19. The system according to claim 17, further comprising a jacket within the main body, configured to at least partially envelope the tool; and wherein the actuating mechanism is configured to switch the auxiliary device from the first configuration preventing displacement of the jacket within the main body of the auxiliary device to the second configuration in which the jacket is released and displacement of the jacket relative to the auxiliary device is permitted, wherein the actuating mechanism is configured to switch the auxiliary device from the first configuration to the second configuration by being positioned on or in the well.

* * * * *